US005301512A

United States Patent [19]

Yamamoto

[11] Patent Number: 5,301,512

[45] Date of Patent: Apr. 12, 1994

[54] METHOD AND APPARATUS FOR MAKING SNOW

[76] Inventor: Yasuo Yamamoto, c/o Wetmaster Kabushiki Kaisha, 25-18, Shimoochiai 4-chome, Shinjuku-ku, Tokyo-to, Japan

[21] Appl. No.: 758,619

[22] Filed: Sep. 12, 1991

[51] Int. Cl.[5] ..... F25C 3/00

[52] U.S. Cl. ..... 62/74; 62/347; 239/2.2

[58] Field of Search ..... 62/74, 347; 239/2.2

[56] References Cited

U.S. PATENT DOCUMENTS

| | | | |
|---|---|---|---|
| 2,480,275 | 8/1949 | van Straten et al. | 239/2.1 X |
| 2,968,164 | 1/1961 | Hanson | 62/74 |
| 3,301,485 | 1/1967 | Tropeano et al. | 62/74 X |
| 3,596,476 | 8/1971 | Jakob et al. | 62/347 |
| 4,222,519 | 9/1980 | Kircher et al. | 62/74 X |
| 4,475,688 | 10/1984 | Hodges | 239/102.2 |
| 4,488,407 | 12/1984 | Delano | 62/74 |
| 4,916,911 | 4/1990 | Duryea et al. | 62/74 X |
| 5,102,043 | 4/1992 | Inoue et al. | 239/2.2 |

*Primary Examiner*—William E. Tapolcai
*Attorney, Agent, or Firm*—Price, Heneveld, Cooper, DeWitt & Litton

[57] ABSTRACT

A method and apparatus for continuously making snow at all times of the year comprises the creation of countless ice crystals from a mist in a controlled environment. The mist may have a ice crystal nucleus added to it to facilitate the development of the ice crystal at higher temperatures. The ice crystals are directed into an ultrasonic field generated by an transducer where the fall rate of the crystals levitated. While the crystals are within the ultrasonic field, the crystals grow into snowflakes as a result of collisions with other crystals. The snowflakes eventually fall out of the ultrasonic field as snow having a more natural appearance than more conventional snow-making techniques.

61 Claims, 5 Drawing Sheets

METHOD AND APPARATUS FOR MAKING SNOW

BACKGROUND OF THE INVENTION

The present invention relates to a novel method and apparatus for making snow and particularly to a method and apparatus for making snow in all seasons.

One method and apparatus for making snow utilizes blocks or cakes of ice which are shaved into fine ice flakes by a rotating cutter. The snow-like ice flakes are blown off, together with a gas, by a blower or compressed air blast. A disadvantage of the shaving method and apparatus is the form of shaved ice which is far from naturally formed snowflakes.

Another method and apparatus for making snow involves a snow making chamber having a screen- or brush-like member on which frost is formed by a spray, ultrasonic atomizer or the like. The frost is then scraped by suitable means to form the snow. A disadvantage of the device is the long time required for frost development, since the frost is formed on the screen- or brush-like member by the mist. Once the frost has been scraped, considerable time is required before new frost can develop, making it impossible to produce snow on a continuous basis. A further disadvantage associated with this method is that the frost, once scraped, tends to harden to a state much different from that of naturally formed snow crystals.

A third method and apparatus provides a mist which is supplied to a snow making chamber to generate ice crystals. The ice crystals are suspended within the chamber by an air stream. As the ice crystals are suspended, they continue to grow into snowflakes. The ice crystals become heavier as they grow and eventually fall out of the air stream due to their weight.

Following this method, it is difficult to suspend the fine ice crystals and grow them into snowflakes having a diameter of several millimeters. An extremely sophisticated control of the air stream is required to achieve the desired suspension density. Accordingly, the ice-crystal growth chamber must be of a height substantially equal to a building five stories high in order to achieve an effective control of the air stream. As a consequence, the apparatus is inconveniently bulky and impractical to use. Moreover, the method requires a time cycle on the order of 20 to 30 minutes to grow the ice crystals in the same manner as in nature, so it is difficult to realize continuous snowfall.

In view of the problems and disadvantages associated with the former methods of making artificial snow, the present invention provides a method for continuously and rapidly making snowflakes which more closely resembles naturally formed snow.

SUMMARY OF THE INVENTION

In accordance with one aspect of the present invention, a method for making snow comprises the steps of generating ice crystals using an ice crystal generator means having a liquid atomizer and freezer. This step is followed by guiding the ice crystals into an ultrasonic field generated by ultrasonic levitating means and levitating the ice crystals within the ultrasonic field so as to make snowflakes.

An apparatus for carrying out the method for making snow comprises an ice crystal generator mechanism having a liquid atomizer mechanism and a freezer mechanism to generate ice crystals. A collector chamber is provided within the freezer to collect the ice crystals from the generator mechanism. An ultrasonic levitating mechanism, located below the collector, is adapted to generate an ultrasonic field and suspend the crystals within the freezer so they may grow. Coupled to the crystal generator is a guiding means used to guide the ice crystals into the collector chamber and the ultrasonic levitating mechanism, respectively.

With the method and the apparatus of the present invention, the ice crystals formed by the ice crystal generator means or mechanism are levitated within the ultrasonic field which is, in turn, generated by the ultrasonic levitating means or mechanism so that the individual ice crystals are combined with the adjacent ice crystals or mist particles to form the snow-like flakes.

BRIEF DESCRIPTION OF THE DRAWINGS

Method and apparatus of the present invention will be more apparent from the following description of preferred embodiments made in reference with the accompanying drawings wherein.

DETAILED DESCRIPTION OF THE PREFERRED EMBODIMENTS

Figure 1:
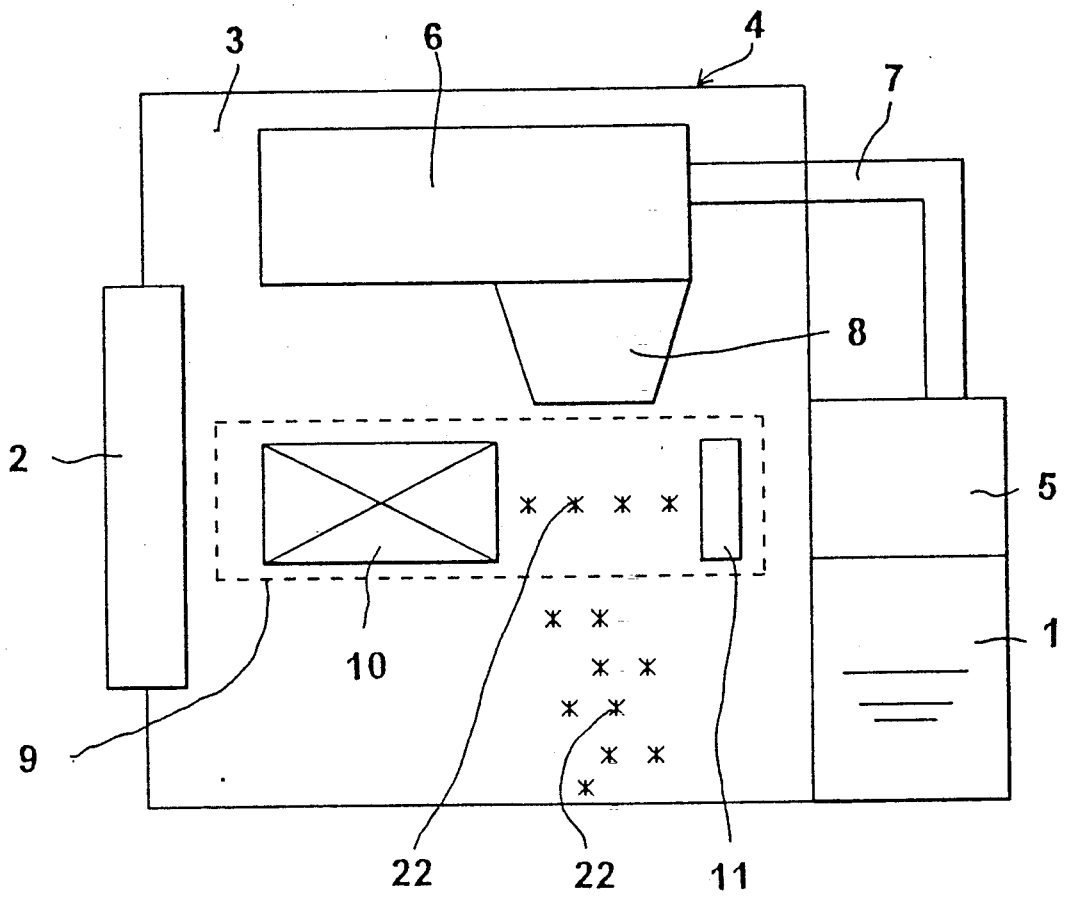
FIG. 1 is a schematic diagram illustrating a basic arrangement of the snow making apparatus according to the invention.

In referring to the drawing figures, like reference numerals will be used to indicate like components, wherein FIG. 1 is a schematic diagram illustrating a basic arrangement of the snow making apparatus according to the invention. The snow making device 10 has a liquid atomizer means or mechanism 12, most preferably in the form of an ultrasonic atomizer. Alternatively, a combination of high pressure pump and nozzle or a steam generator may work as the liquid atomizer mechanism so far as an effective mist generator can be obtained. A freezer means or mechanism 14 cools a freezing chamber 16 within an insulated cabinet 18 comprising an ice crystal generator means or mechanism. The crystal generator 18 is adapted to generate countless ice crystals. The insulated cabinet of the crystal generator may be constructed from a variety of materials including polyvinyl chloride sheeting or stainless steel. The cabinet may be insulated using polyurethane foam or the like to maintain the preferred environment within the cabinet. It is preferred that portions of the cabinet contain windows. Such window should be insulated windows having triple panes to provide an insulated window that will not cloud or fog while the snow making apparatus is functional.

Ice crystals are generated in an environment at a temperature lower than approximately −5° C. if crystal nuclei are present. Even in the absence of such ice crystal nuclei, it has been found that ice crystals are generated from mist in an environment at a temperature lower than −40° C. Accordingly, freezer mechanism 14 having an ability of cooling the environment to a temperature lower than −40° C., may be combined with the liquid atomizer mechanism 12 to provide an ice crystal generator 18 which is effective to generate countless ice crystals.

It will be possible to generate ice crystals even by using a freezer mechanism 14 having a limited ability to cool to a temperature of −5° C. if the crystal generator 18 is combined with a crystal nucleus generator means or mechanism 20. Preferably nucleus generator 20 is adapted to atomize a mixture of colloidal silver iodide solution and water having a concentration of silver iodide between 0.1 to 0.4 grams per liter. Alternatively, the colloidal silver iodide solution may be mixed into the liquid contained in liquid atomizer mechanism 12 to achieve the desired generation of ice crystal nuclei. Other ice nucleus material may be used such as salt, clay and certain ice nucleus bacillus.

It may be contemplated that a temperature lower than −40° C. be established within freezing chamber 16 to generate the ice crystals. This may be achieved by utilizing, for example, a Peltier element or dry ice. Alternatively, cooling may be achieved by adiabatic expansion (an increase in volume without heat loss) by the discharge of a high pressure fluid (gas).

Referring to FIG. 1, reference numeral 22 refers to a collector chamber adapted to collect mist particles generated by liquid atomizer mechanism 12 and passed through a mist conduit 24. Within collector chamber 22, the mist droplets are being converted to ice crystals in a sub-zero environment generated by freezer mechanism 14. While it will suffice to maintain the temperature within collector chamber 22 below −5° C. if the ice crystal nucleus generator mechanism 20 is used, it will be necessary to maintain the temperature within collector chamber 22 at approximately −40° C. or provide an inlet of collector chamber 22 with a suitable means such as a Peltier element for establishing a super-cooled environment having a temperature on the order of −40° C.

Reference numeral 26 designates a mist guiding chamber adapted to guide the mist, together with the ice crystals, into an ultrasonic field generated by an ultrasonic levitating mechanism 28 described in greater detail below. The conical shape of the chamber 26 is positioned above the ultrasonic levitating mechanism 28 such that the outlet to the guide is above the area where the ultrasonic field is generated.

Figure 2:
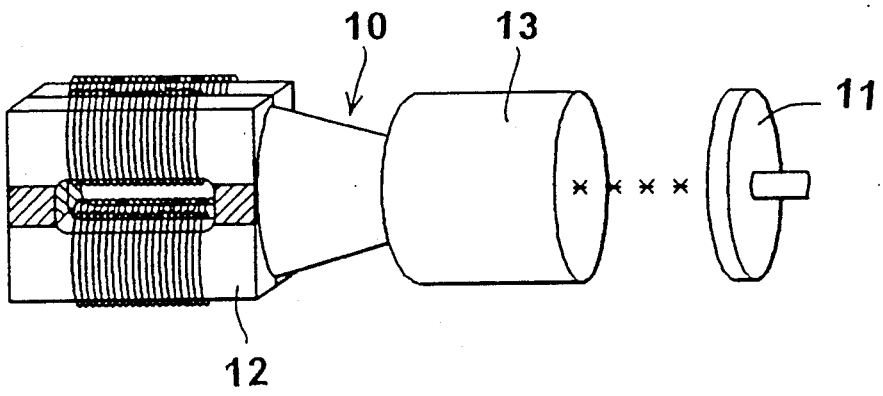
FIG. 2 is a perspective view illustrating one embodiment of the ultrasonic levitating mechanism.

The ultrasonic levitating mechanism 28 introduced above is comprised of an ultrasonic transducer assembly 30 and a reflector 32. As illustrated in FIG. 2, an ultrasonic transducer assembly 30 is basically comprised of ultrasonic transducer 34 having a cylindrical metallic horn 36 and distant therefrom is reflector 32 so as to be opposed to cylindrical metallic horn 36. Generated between cylindrical horn 36 and reflector 32 is an ultrasonic standing wave through which ice crystals 38 are passed. The temperature within the standing wave is preferably maintained at approximately −15° C. Opposing surfaces of cylindrical horn 36 and reflector 32 may be slightly concave to generate a linear standing wave field, as illustrated in FIG. 1, and thereby levitate the ice crystals 38 in the air within the ultrasonic standing wave to provide sufficient time for the crystals to grow into snowflakes. Reflector 32 is preferably position-adjustable so as to vary the distance to horn 36 and change the amount of reflected energy between the horn and reflector.

Figure 3:
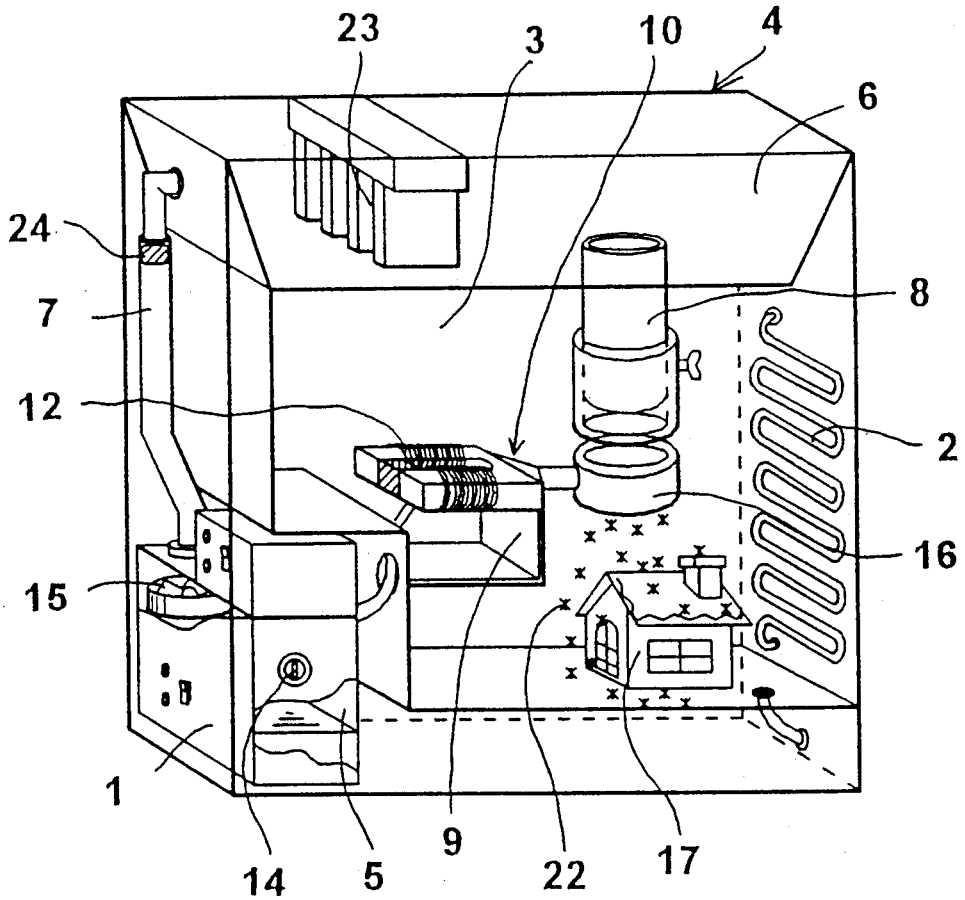
FIG. 3 is a perspective view illustrating one embodiment of the apparatus constructed according to the invention.
Figure 4:
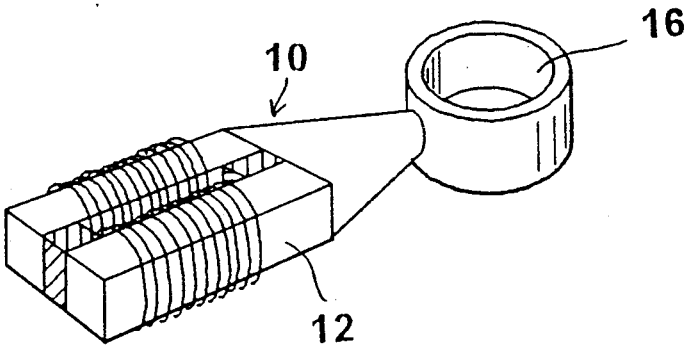
FIG. 4 is a perspective view illustrating a preferred embodiment of the ultrasonic levitating mechanism.

FIG. 3 is a perspective view illustrating one embodiment of the apparatus 10 constructed according to the invention in which the same reference numerals are used to show the same parts shown in FIG. 1. In this embodiment, colloidal silver iodide solution is mixed with a quantity of water contained in liquid atomizer mechanism 12 to obtain a concentration of colloidal silver iodide between 0.1 and 0.4 grams per liter. The mixture within atomizer 12 serves as the ice crystal nucleus generator means. As a consequence, no additional space is required for the ice crystal nucleus generator mechanism if liquid atomizer mechanism 12 is provided with a refill port 40 for the mixed solution.

Figure 6:
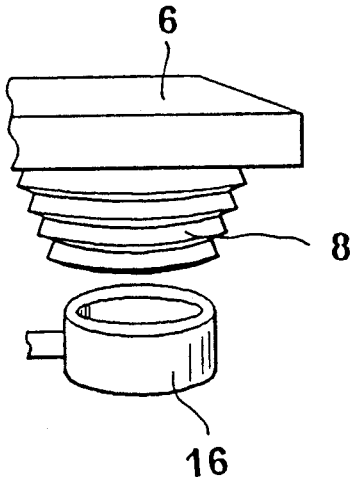
FIG. 6 is a perspective view illustrating a preferred embodiment of the mist guiding means.

Reference numeral 42 designates a fan provided within liquid atomizer mechanism 12 to direct the mist generated by the liquid atomizer, through conduit 24 and into collector chamber 22. The flow rate of the air within conduit 24 may be in the range of 0.2 to 0.8 meters per second. Located within mist conduit 24 is a valve 52 used to control the airflow rate within the conduit and thereby regulate the mist stream. In this specific embodiment, there is provided within collector chamber 24 a Peltier element 44 adjacent the point where mist conduit 24 enters collector chamber 22 serving to achieve a partial supercooling effect. Extending downwardly from the bottom of collector chamber 22 is a cylindrical mist guiding chamber 26 for directing the mist and ice crystals into the ultrasonic field. Concentrically received about guiding chamber 26 and adapted to slide about the guide is a sleeve 48 which may be fixed in position by a fastener 50 such as a winged screw. FIG. 6 illustrates another embodiment of mist guiding chamber 26 disposed beneath collector chamber 22. More specifically, mist guiding chamber 26 is a bellows allowing the outlet of chamber 22 to be position-adjusted above the ultrasonic standing wave generated by the transducer horn 36.

Figure 7:
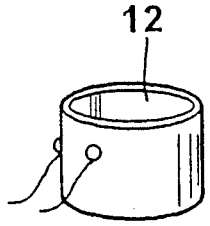
FIG. 7 is a perspective view illustrating an embodiment of the annular ultrasonic transducer.

The ultrasonic levitating mechanism 28 shown in FIG. 3 comprises ultrasonic transducer assembly 30 and annular metallic horn 36 mounted to a bracket 29 and adapted to generate the standing wave used to levitate the ice crystals. The ice crystals 38 together with the mist particles, also shown as 38, are levitated or suspended in the horn by the ultrasonic standing wave. The ultrasonic energy causes the ice particles to collide with the mist particles and freeze thereon and grow to form the snowflakes. The growth of the snowflakes continue by way of ultrasonic cohesion until the size of the snowflakes cause them to fall from the ultrasonic field. Annular metallic horn 36, shown in FIG. 3, may be made of DURALUMINUM 56S with the annulus having a height of 35 mm, an inner diameter of 50 mm and an outer diameter of 58 mm. FIG. 7 illustrates an alternate embodiment of ultrasonic tranducer 120 in the form of an annular transducer. Referring again to FIG. 3, reference numeral 54 designates a toy house placed immediately below annular metallic horn 36 so that the artificial snow falls directly onto its roof to create the sense of real snowfall.

Figure 5:
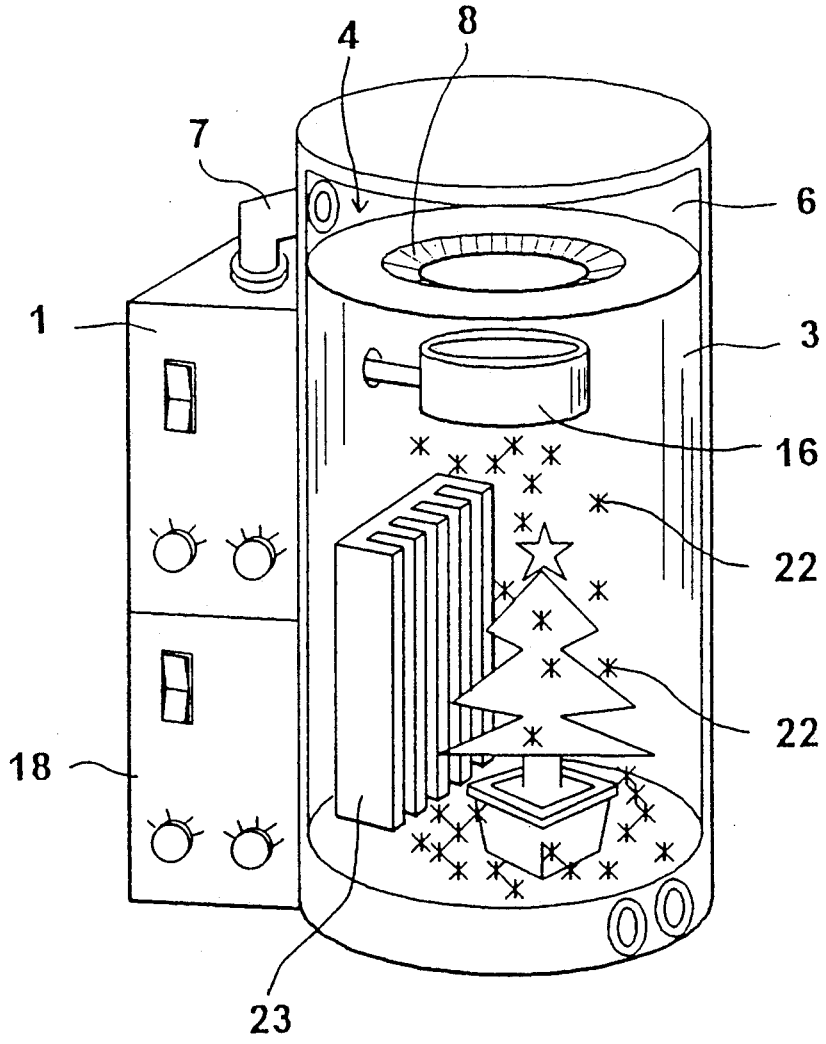
FIG. 5 is a perspective view illustrating another embodiment of the apparatus constructed in accordance with the invention.

Referring to FIG. 5, there is illustrated another embodiment of the apparatus 10 constructed in accordance with the present invention, in which freezing chamber 16 is defined by a cylindrical wall 56 made of transparent material. An ultrasonic field generated by an ultrasonic generator 58 causes horn 36 to generate standing waves not only within annular metallic horn 36 but also between transparent wall 56 of the freezing chamber and annular metallic horn 36 so that the snow making occurs not only inside but also outside annular metallic horn 36 so as to fall on and around a desired target such as the tree 59.

Figure 8:
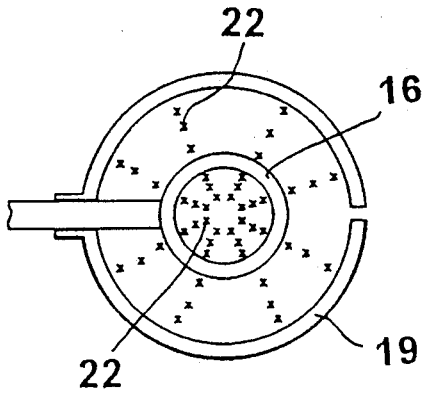
FIGS. 8 through 10 are perspective views illustrating various embodiments of the reflectors.
Figure 9:
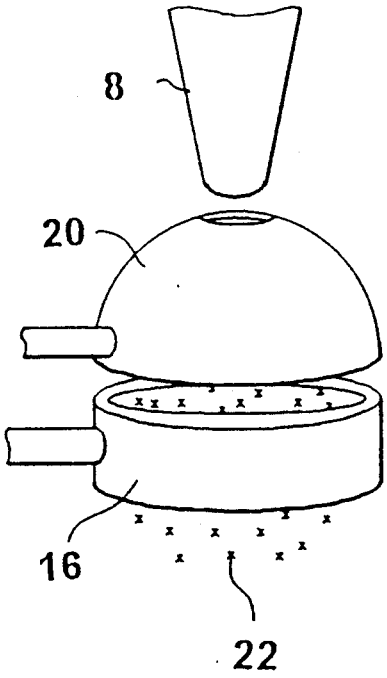
Figure 10:
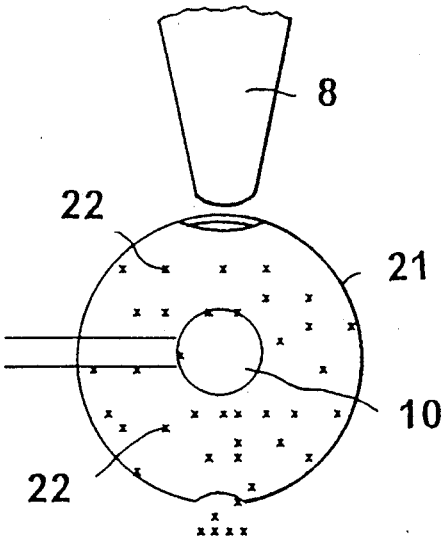

Referring to FIG. 8, an annular metallic horn 36 may be surrounded by an annular reflector 60 which is radially expansible to obtain the snow making effect shown by crystals 38 not only inside but also outside annular metallic horn 36. FIG. 9 illustrates an alternative arrangement of the ultrasonic horn and reflector such that there is provided above annular metallic horn 36 a hemispherical or dome-shaped reflector 62 while FIG. 10 illustrates a spherical ultrasonic transducer assembly 64 surrounded by a hollow spherical transparent reflector 66 to make the snowflakes 38. The spherical reflector also contains a upper and a lower port 68, 70 to allow the mist and ice crystals 38 to enter and the snowflakes to exit the ultrasonic field.

The best mode contemplated for making the snowflakes using the method and the apparatus as described above will be described with reference to the schematic diagram shown by FIG. 1 wherein the space within freezing chamber 16 and particularly the space within collector chamber 22 are cooled in advance by the freezer means or mechanism 14. The temperature within collector chamber 22 may be lower than −5° C. if there is provided the ice crystal nucleus generator means or mechanism 20. However, if there is not provided such ice crystal nucleus generator means or mechanism 20, the temperature within the freezing chamber preferably is maintained at a level on the order of −40° C. alternately, the collector chamber may be provided with any suitable super-cooling mechanism such as Peltier element 44 so that the space within said collector chamber is partially maintained at a temparature on the order of −40° C.

A quantity of the liquid is sprayed by liquid atomizer mechanism 12 into collector chamber 22. The liquid may be colored, for example wine, fruit juice, or liquor may be used to generate attractively colored snowflakes. Mist particles having been sprayed into collector chamber 26 are partially converted therein into ice crystals and then discharged together with the mist through mist guiding chamber 26 into the ultrasonic field. These ice crystals and mist particles 38 are directed into the ultrasonic field created by ultrasonic levitating mechanism 28 to suspend or levitate both in the standing wavefield while being levitated, the ice crystals and mist particles are bonded together under the effect of ultrasonic cohesion and thereby form snowflakes. The initial snowflakes attract further additional ice crystals and mist particles to form larger snowflakes and remain within a low pressure region in the ultrasonic field under a differential pressure of ultrasonic standing waves without being in contact with any portion of the apparatus. The ultrasonic cohesion effect continues to grow the snowflake until the size thereof reaches the order of several square millimeters and its weight correspondingly increases and falls from the ultrasonic standing wave. Each of such snow making cycles is in the order of several seconds, so the snow making as well as snow fall can be realized in a relatively continuous manner. It should be understood that the size of each snowflake can be more or less adjusted by regulating the ultrasonic output level and/or the frequency and the shape of each snowflake can be varied into two-dimensional or three-dimensional shapes such as spherical shape by changing a distribution of the ultrasonic field using the adjustable reflectors and mist guiding chambers.

While the invention has been described with respect to the relatively compact apparatus, a plurality of the ultrasonic levitating mechanisms may be provided side-by-side or a single ultrasonic floating mechanism may be horizontally moved to enlarge the apparatus to some degree and thereby to make a correspondingly larger quantity of snow.

As is apparent from the foregoing description, the method and apparatus for making snow according to the present invention allow the artificial snowflakes closely similar to the natural snowflakes to be effectively made in an artificial manner, since the snowflakes are free from contact with any portion of the apparatus during formation thereof and the snowflakes are made as the ice crystals are floated within the ultrasonic field. Furthermore, each of the snow making cycles is in the order of several seconds because the snow making is achieved by utilizing the ultrasonic cohesion effect as has been mentioned above and, therefore, snow making as well as snow fall can be continuously presented in a practically natural manner. Additionally, no large equipment, for example, of a height corresponding to the standard building which is five stories high is required but a very compact apparatus suffices to realize the artificial snow making. Accordingly, the present invention can be effectively and efficiently utilized in a show window display, a snow resisting test for building, science teaching aids, an artificial slope, etc.

The embodiments of the invention in which an exclusive property or privilege is claimed are defined as follows.

1. A method for making snow, comprising the steps of:

continuously generating a plurality of ice crystals;

directing said continuously generated ice crystals into a standing-wave ultrasonic field;

growing said ice crystals disposed within said ultrasonic field into snowflakes that fall out of said ultrasonic field as snow; and using ice crystal nuclei during the step of generating a plurality of ice crystals.

2. The method as recited in claim 1, wherein the step of continuously generating a plurality of ice crystals comprises the steps of:

generating a mist; and cooling said mist to form said ice crystals.

3. The method as recited in claim 1, wherein the step of growing said ice crystals into snowflakes further comprises the step of causing said ice crystals to collect with each other within said ultrasonic field to form said snowflakes.

4. The method as recited in claim 1, wherein the step of growing said ice crystals within said standing-wave ultrasonic field into snowflakes comprises the steps of:

generating said standing-wave ultrasonic field in a first plane; and passing said ice crystals through said standing-wave ultrasonic field in a direction not contained in said first plane.

5. The method as recited in claim 4, further comprising the steps of colliding said ice crystals with supercooled mist within said ultrasonic field causing said super-cooled mist to adhere to said ice crystal and freeze, increasing the size of said ice crystal.

6. A method for making snow, comprising the steps of:

continuously generating a plurality of ice crystals;

directing said continuously generated ice crystals into an ultrasonic field;

growing said ice crystals disposed within said ultrasonic field into snowflakes that fall out of said ultrasonic field as snow, the step of growing said ice crystals within said ultrasonic field into snowflakes includes generating said ultrasonic field in a first plane; and passing said ice crystals through said ultrasonic field in a direction not contained in said first plane; and wherein the step of generating said ultrasonic field in said first plane includes generating a standing-wave ultrasonic field; guiding said standing-wave ultrasonic field in a direction parallel to said first plane; and maintaining said standing-wave ultrasonic field within a predetermined region.

7. The method as recited in claim 6, wherein the step of guiding said standing-wave ultrasonic field further comprises the step of passing an ultrasonic signal through a horn.

8. The method as recited in claim 6, wherein the step of guiding said standing-wave ultrasonic field further comprises the step of generating a standing wave in an annular horn.

9. The method as recited in claim 6, wherein the step of guiding said standing wave field further comprises the step of generating a standing-wave in a spherical direction.

10. The method as recited in claim 9 further comprising the step of retarding a descent of said ice crystals in said ultrasonic field thus increasing the collisions of said ice crystal with said super-cooled mist within said ultrasonic field to form said snowflakes.

11. An apparatus for making snow, comprising:

means for generating ice crystals;

means, generating a standing-wave ultrasonic field, and receiving said ice crystals for growing said ice crystals into snowflakes, said snowflakes falling from said growing means as snow; and wherein said means for generating ice crystals further includes an ice crystal nucleus generator mechanism.

12. An apparatus as recited in claim 11, wherein said means for generating said ice crystals comprises:

means for generating a mist; and means for cooling said mist to form said ice crystals.

13. The apparatus as recited in claim 12, wherein said means for cooling is a Peltier element.

14. The apparatus as recited in claim 12, further comprising means for directing said ice crystals from said generating means to said growing means.

15. The apparatus as recited in claim 14, wherein said growing means comprises means for producing a standing-wave ultrasonic field.

16. An apparatus for making snow, comprising:

means for generating ice crystals including an ice crystal nucleus generator mechanism;

means for generating a mist;

means for cooling said mist to form said ice crystals;

means, generating an ultrasonic field and receiving said ice crystals, for growing said ice crystals into snowflakes, said snowflakes falling from said growing means as snow;

means for directing said ice crystals from said generating means to said growing means; and wherein said means for growing said ice crystals includes a transducer, means connected to said transducer for guiding said ultrasonic field, and means spaced from said guide means for reflecting said ultrasonic field.

17. The apparatus as recited in claim 16, further comprising means for directing said mist from said mist generating means to said cooling means; and means for adjusting a flow rate of said mist within said mist directing means.

18. The apparatus as recited in claim 16, wherein said guiding means comprises a cylindrical horn attached to said transducer and directed toward said reflecting means.

19. The apparatus as recited in claim 16, wherein said guiding means and said reflecting means have opposing concave surfaces for producing a linear ultrasonic field therebetween.

20. The apparatus as recited in claim 16, wherein said guiding means comprises an annular horn.

21. The apparatus as recited in claim 16, wherein said reflecting means is a disc having a substantially flat surface opposed to said guiding means.

22. The apparatus as recited in claim 20 wherein said reflecting means comprises an expansible annulus concentric about said annular horn.

23. The apparatus as recited in claim 16, wherein said reflecting means comprises a hemisphere disposed above said guiding means and having a hole at its vertex and positioned beneath said means for directing said ice crystals from said generating means to said guiding means.

24. The apparatus as recited in claim 16, wherein said means for guiding said ultrasonic field comprises a globe connected to an end of said tranducer.

25. The apparatus as recited in claim 24, wherein said reflecting means comprises a sphere enclosing said globe and concentric therewith, said sphere having a first and a second diametrically opposing port wherein said first port is positioned beneath said means for directing said ice crystal from said generating means to said means for guiding said ultrasonic field.

26. An apparatus for making snow, comprising:

means for generating a mist;

means for generating ice crystals from said mist; and a standing-wave ultrasonic field generator receiving said ice crystals for growing snowflakes, including a transducer, a wave guide extending from said transducer, and reflecting means spaced from said wave guide and adapted to reflect energy received from said wave guide to create a standing-wave therebetween, said snowflakes falling from said growing means as snow.

27. The apparatus as recited in claim 26 further comprising means for guiding said ice crystals from said ice crystal generating means to said growing means.

28. The apparatus as recited in claim 27 further comprising means for blowing said mist from said mist generating means to said ice crystal generating means.

29. The apparatus as recited in claim 26, wherein said reflecting means comprises a tabular reflector having a substantially flat surface perpendicular and distant to said wave guide.

30. The apparatus as recited in claim 26, wherein said reflecting means comprises a ring substantially surrounding said wave guide and concentric therewith.

31. The apparatus as recited in claim 26, wherein said reflecting means comprises a semi-spherical reflector disposed above said wave guide and having a hole located in a top thereof to allow said ice crystals to pass therethrough to said wave guide.

32. The apparatus as recited in claim 26, wherein said reflecting means comprises a spherical reflector concentrically enclosing said wave guide and having a first and second passage therein to allow said ice crystals to pass vertically therethrough.

33. The apparatus as recited in claim 26, wherein said wave guide comprises a spherical ultrasonic generator.

34. The apparatus as recited in claim 27, wherein said means for guiding said ice crystals from said ice crystal generating means is adjustable.

35. An apparatus for making snow, comprising:
means for generating a mist;
means for generating ice crystals from said mist;
an ultrasonic field generator including a transducer
a wave guide extending from said transducer wherein said wave guide comprises an annular horn extending from said transducer; and
reflecting means spaced from said wave guide and adapted to reflect energy received from said wave guide to create a standing wave there between, and receiving said ice crystals from said generating means for growing snowflakes, said snowflakes falling from said growing means as snow.

36. A method for making snow, comprising the steps of:
continuously generating a plurality of ice crystals;
directing said continuously generated ice crystals into an ultrasonic field; and
growing said ice crystals disposed within said ultrasonic field into snowflakes that fall out of said ultrasonic field;
wherein the step of growing said ice crystals disposed within said ultrasonic field into snowflakes further includes steps of:
generating said ultrasonic field in a first plane; and
passing said ice crystals through said ultrasonic field in a direction not contained in said first plane; and
wherein the step of generating said ultrasonic field in the first plane first includes steps of:
generating an ultrasonic field;
guiding said ultrasonic field in a direction parallel to said first plane;
generating a standing wave in said ultrasonic field; and
levitating said ice crystals in said ultrasonic field.

37. The method as recited in claim 36, wherein the step of guiding said ultrasonic field further includes a step of passing an ultrasonic signal through a horn.

38. The method as recited in claim 36, wherein the step of guiding said ultrasonic field further includes a step of generating a standing wave in an annular horn.

39. The method as recited in claim 36, wherein the step of guiding said ultrasonic field further includes a step of generating a standing wave in a spherical direction.

40. The method as recited in claim 36, further including a step of colliding said ice crystals with super-cooled mist within said ultrasonic field causing said super-cooled mist to adhere to said ice crystals and freeze and thereby increasing the size of said ice crystals.

41. The method as recited in claim 36, further including a step of levitating said ice crystals in said ultrasonic field thus increasing the collisions of said ice crystals with said super-cooled mist within said ultrasonic field to form said snowflakes.

42. The method as recited in claim 36, wherein the step of generating a plurality of ice crystals utilizes ice crystal nuclei.

43. An apparatus for making snow, comprising:
means for generating ice crystals; and
means for receiving said ice crystals for growing said ice crystals into snowflakes falling from said growing means as snow;
wherein said means for generating said ice crystals comprises:
means for generating a mist; and
means for cooling said mist to form said ice crystals;
wherein said apparatus further comprising means for transferring said ice crystals from said generating means to said growing means;
wherein said growing means includes means for generating an ultrasonic field; and
wherein said means for generating the ultrasonic field comprises:
a transducer; and
means electrically connected to said transducer to guide said ultrasonic field and to generate a standing wave so as to levitate said ice crystals in said ultrasonic field.

44. The apparatus as recited in claim 43, further including:
means for transferring said mist from said mist generator means to said cooling means; and
means for adjusting a flow rate of said mist within said mist directing means.

45. The apparatus as recited in claim 43, wherein said standing wave generator means comprises a cylindrical horn attached to said transducer and reflecting means spaced therefrom.

46. The apparatus as recited in claim 45, wherein said cylindrical horn and said reflecting means have opposing concave surfaces for producing a linear ultrasonic field therebetween.

47. The apparatus as recited in claim 43, wherein said standing wave generator means comprises an annular horn.

48. The apparatus as recited in claim 45, wherein said reflecting means comprises a disc having a substantially flat surface.

49. The apparatus as recited in claim 47, said standing wave generator means comprises an expansible annulus concentric about said annular horn.

50. The apparatus as recited in claim 43, wherein said standing wave generator means comprises a hemisphere disposed above said guiding means and having a hole at its vertex and positioned beneath said means for transferring said ice crystals from said generating means to said guiding means.

51. The apparatus as recited in claim 43, wherein said standing wave generator means comprises a globe connected to an end of said transducer.

52. The apparatus as recited in claim 51, wherein said standing wave generator means comprises a sphere concentrically enclosing said globe, said sphere having first and second diametrically opposing ports and wherein said first port is positioned beneath said means for transferring said ice crystals from said generating means to said means for guiding said ultrasonic field.

53. The apparatus as recited in claim 43, wherein said means for generating ice crystals includes means for generating ice crystal nuclei.

54. An apparatus for making snow, comprising:

means for generating a mist;

means for generating ice crystals from said mist, including an ice crystal nucleus generator mechanism; and ultrasonic means receiving said ice crystals for growing snowflakes, said snowflakes falling from said growing means as snow;

wherein said ultrasonic means comprises:

a transducer; and means including a wave guide extending from said transducer for generating a standing wave.

55. The apparatus as recited in claim 54, wherein said means for generating a standing wave comprises an annular horn extending from said transducer.

56. The apparatus as recited in claim 54, wherein said means for generating a standing wave comprises a tabular reflector having a substantially flat surface perpendicular and distant to said wave guide.

57. The apparatus as recited in claim 54, wherein said means for generating a standing wave comprises a ring substantially surrounding said wave guide and concentric therewith.

58. The apparatus as recited in claim 55, wherein said means for generating a standing wave comprises a semispherical reflector disposed above said wave guide and having a hole located in a top thereof to allow said ice crystals to pass therethrough to said wave guide.

59. The apparatus as recited in claim 54, wherein said means for generating a standing wave comprises a spherical reflector concentrically enclosing said wave guide and having first and second passages therein to allow said ice crystals to pass vertically therethrough.

60. The apparatus as recited in claim 54, wherein said ultrasonic means comprises a spherical wave generator.

61. The apparatus as recited in claim 54, wherein said means for transferring said ice crystals from said generating means is adjustable.

* * * * *

UNITED STATES PATENT AND TRADEMARK OFFICE

CERTIFICATE OF CORRECTION

PATENT NO. : 5,301,512

DATED : April 12, 1994

INVENTOR(S) : Yasuo Yamamoto

It is certified that error appears in the above-indentified patent and that said Letters Patent is hereby corrected as shown below:

In the Abstract, lines 7 and 8:
After "where the" delete "fall rate of the";

Col. 5, line 36:
"alternately" should be --alternatively--;

Col. 6, line 10:
"floating" should be --levitating--;

Col. 7, line 31, claim 9:
After "wave" insert --ultrasonic--;

UNITED STATES PATENT AND TRADEMARK OFFICE

CERTIFICATE OF CORRECTION

PATENT NO. : 5,301,512

DATED : April 12, 1994

INVENTOR(S) : Yasuo Yamamoto

It is certified that error appears in the above-indentified patent and that said Letters Patent is hereby corrected as shown below:

Column 7, line 35, delete "retarding a decent of" and insert therefor --levitating --.

Column 9, line 44, claim 36: "first includes" should be --further includes --.

Column 12, line 7, claim 58: "claim 55" should be --claim 54 --.

Signed and Sealed this

Twenty-ninth Day of November, 1994

*Attest:*

Bruce Lehman

BRUCE LEHMAN

*Attesting Officer*

*Commissioner of Patents and Trademarks*